United States Patent [19]

Ando et al.

[11] 4,284,697

[45] Aug. 18, 1981

[54] IMAGE FORMATION METHOD

[75] Inventors: Yujiro Ando; Yukimasa Shinohara, both of Yokohama; Katsunobu Ohara, Kawasaki, all of Japan

[73] Assignee: Canon Kabushiki Kaisha, Tokyo, Japan

[21] Appl. No.: 894,709

[22] Filed: Apr. 10, 1978

Related U.S. Application Data

[63] Continuation of Ser. No. 700,850, Jun. 29, 1976, abandoned.

[30] Foreign Application Priority Data

Jul. 8, 1975 [JP] Japan ..... 50/83752

[51] Int. Cl.[3] ..... G03G 13/22

[52] U.S. Cl. ..... 430/53; 355/3 SC; 355/77

[58] Field of Search ..... 355/3 SC, 3 R, 3 DR, 355/3 TE, 4, 11, 77; 430/53, 31

[56] References Cited

U.S. PATENT DOCUMENTS

| | | | |
|---|---|---|---|
| 3,811,765 | 5/1974 | Blake | 355/3 SC |
| 3,898,085 | 8/1975 | Suzuki et al. | 355/3 SC |
| 3,937,571 | 2/1976 | Krulik et al. | 355/3 SC |
| 3,976,484 | 8/1976 | Ando et al. | 430/53 |

*Primary Examiner*—R. L. Moses

*Attorney, Agent, or Firm*—Fitzpatrick, Cella, Harper & Scinto

[57] ABSTRACT

In an image formation method of forming an image by modulating an ion flow or charged particles with the aid of a screen having a number of fine passage openings, at least one of the screen and an image reception member is of arcuate cross-section at the modulating position and an image is formed on the screen. One of the screen and the image reception member which is greater in radius is rotated or moved at a higher velocity than the other, thereby modulating the image onto the image reception member.

30 Claims, 10 Drawing Figures

IMAGE FORMATION METHOD

This is a continuation of application Ser. No. 700,850 filed June 29, 1976, now abandoned.

BACKGROUND OF THE INVENTION

1. Field of the Invention

This invention relates to a method of forming an image by modulating a flow of ions or charged particles such as toner particles with the aid of a screen having a number of fine passage openings or a screen having a character- or otherwise shaped opening.

2. Description of the Prior Art

The screen used with the present invention may be, for example, a photosensitive screen which, as described in our U.S. Application Ser. No. 480,280, comprises an electrically conductive member having a number of fine openings formed by knitting a thin metal wire or by etching or electroforming, and at least a photoconductive member overlaid on the conductive member. Such a screen may form thereon a primary latent image by a combination of charging from a corona discharger or like means and application of light such as the light from an image original. By the utilization of the electric field in the opening portion of the screen, the passage of the ion flow or charged particles are controlled or modulated in accordance with the electrostatic pattern of the primary latent image. In this manner, a latent image is formed on a recording medium which may be a chargeable sheet such as insulating paper or an image reception member such as an insulating drum, and such latent image is called a secondary latent image. The secondary latent image may directly be developed for utilization or may first be developed and then transferred to another recording medium for utilization. These techniques of electrophotography are disclosed in U.S. Pat. No. 3,582,206, U.S. Pat. No. 3,680,954 and our U.S. Application Ser. No. 480,280, and the screens described in these patents and application are of course usable with the present invention.

In an image formation apparatus using the abovedescribed method of image formation, it is necessary that both or one of the screen and the recording medium be formed into a cylindrical shape or, at least at the modulating position, formed into an arcuate shape, in order to attain high speed image formation and compactness of the apparatus. However, it has been found that the modulation of the ion flow or charged particles effected with the screen and the recording medium having different radii or different curvatures at the modulating position results in the formation of an unclear modulated image. If the screen and the recording medium are equal in curvature, no blur will be created in the formed image. However, if both the screen and the recording medium such as insulating drum or the like are cylindrically shaped, then the recording member makes it necessary that various members such as a developing device, transfer means and cleaning means be disposed around it. Thus, reduction in the diameter of the cylindrically shaped recording medium as described above is necessarily limited. On the other hand, if the retention copying is carried out wherein image formation is effected a number of times from a single primary latent image, and if the screen is an endless one, the circumferential length of the screen should preferably be equal to the sum of the length of a copy sheet and the space interval at which copy sheets are fed, or a multiple of such sum. Therefore, in order to shorten said space interval of paper feeding for the purpose of increasing the copying speed, the diameter of the cylindrical screen should desirably be as small as possible. For these reasons, it is difficult to set up the diameters of the screen and the recording medium to equal values in an apparatus for which high speed operation is desired.

SUMMARY OF THE INVENTION

It is an object of the present invention to discover the causes of the above-noted problems and present a solution thereto and to produce a blur-free or sharp, clear image even if the screen and the recording medium differ in curvature.

It is another object of the present invention to present an image formation method which satisfies these conflicting optimum conditions and ensures the formed image to be free of blur and which is suited for high-speed operation.

It is still another object of the present invention to present a method of preventing a formed image from elongating toward the recording medium for a sharp, clear image to be obtained, and specific means for such method.

It is yet another object of the present invention to present an image formation method which is capable of producing a copy image faithful to an original image at high speed and in a simple manner.

The electrophotographic method of the present invention which may achieve these objects is an image formation method in which both or either of a screen having a number of fine openings and bearing image information and a recording medium which is an image reception member is formed into a cylindrical shape at least in the portions thereof opposed at the modulating position and a flow of ions or charged particles is modulated onto the recording medium to form an image thereon. A feature of this method is that if both of the screen and the recording medium are formed into cylindrical shapes of different radii at the modulating position, the one with the larger radius is rotated at a higher velocity than the one with the smaller radius and that if one of the screen and the recording medium is cylindrically shaped and the other is planar, the planar one is moved at a higher velocity than the cylindrical one. Another feature of the present method is that, whenever the image on the recording medium elongates in the circumferential direction of the medium and such elongation must be corrected, the primary latent image being formed is reduced or enlarged in the circumferential direction of the screen in accordance with the velocity of rotation or movement thereof.

DESCRIPTION OF THE PREFERRED EMBODIMENTS

Before the present invention is described in detail, the construction of the screen disclosed in the aforementioned U.S. Application Ser. No. 480,280 and an example of the process of forming a latent image by the use of such screen will be generally described with reference to FIGS. 1 to 5 to illustrate an example of the screen used with the present invention.

Figure 1:
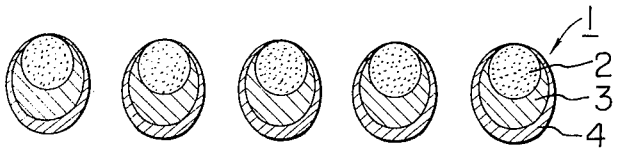
FIG. 1 is a fragmentary, enlarged cross-sectional view of an exemplary screen used for illustrating the present invention and for schematically showing the construction of the screen.

FIG. 1 is a fragmentary enlarged cross-sectional view for schematically showing the construction of the screen. The screen 1 comprises an electrically conductive member 2 having a number of fine openings and a photoconductive member 3 and an insulating member 4 overlaid in layers on the conductive member 2 so that the conductive member is partly exposed.

With regard to FIGS. 2 to 5, description will be made by taking as an example the case where the photoconductive member in use has such a characteristic that positive pores are introduced into the photoconductive member even in the dark region thereof. In other words, it is assumed that the photoconductive member 3 is a semiconductor having positive pores such as Se or other alloy as the main carrier.

Figure 2:
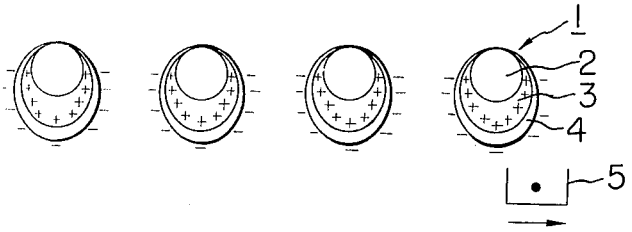
FIGS. 2 to 4 illustrate the steps of a process for forming a primary latent image on the screen of FIG. 1.

FIG. 2 illustrate the result obtained by carrying out the step of applying a primary voltage. As shown there, the insulating member of the screen 1 is uniformly charged to the negative polarity (−) by conventional charger means such as corona discharger or the like. By such charging, the positive pores are introduced into the photoconductive member 3 through the conductive member 2 and captured in the interface adjacent the insulating member 4. Designated by 5 is a corona discharger.

Figure 3:
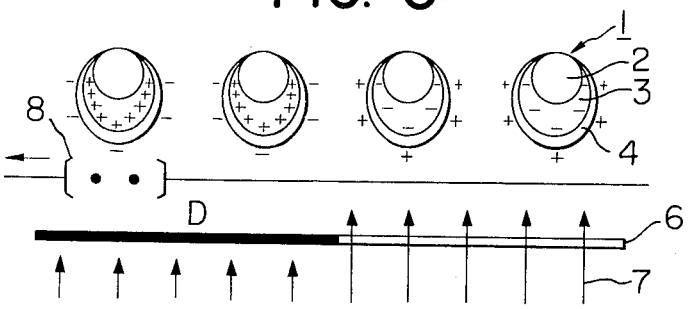

FIG. 3 shows the result obtained by application of a secondary voltage and application of image light being carried out simultaneously. The secondary voltage used is corona discharger from a source of voltage comprising an AC voltage with a bias voltage of the positive polarity superposed thereon. Where the attenuation characteristic of the photoconductive member 3 in the dark is slow, the application of the voltage and the application of the image light need not always be carried out simultaneously but may take place in succession. Reference numeral 6 designates an image original having a light region L and a dark region D, 7 denotes light rays and 8 a corona discharger. The application of the image is shown to be carried out by the light passed through the image original, but of course, it may also be carried out by the light reflected by the image original.

Figure 4:
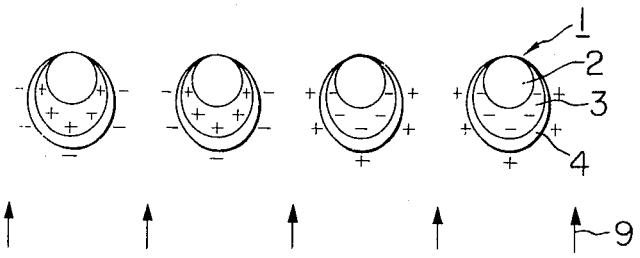

FIG. 4 shows the result obtained by subjecting the screen 1 to overall exposure. As will be seen, the surface potential of the screen 1 rapidly changes to a potential proportional to the quantity of surface charge on the insulating member 4 to form a primary latent image. Reference numeral 9 designates light rays.

Figure 5:
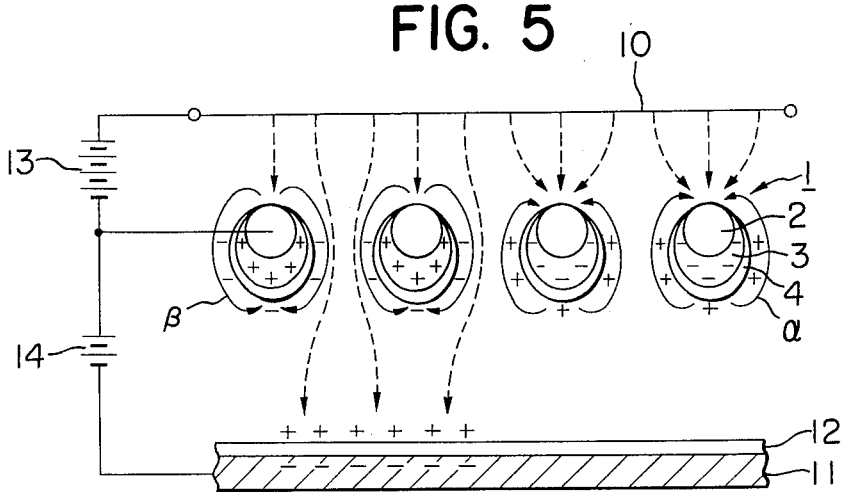
FIG. 5 illustrates the step of forming a secondary latent image from the primary latent image on the same screen.

FIG. 5 shows the condition in which the ion flow is being modulated by the primary latent image so that the positive of the original image is formed on a recording medium. Reference numeral 10 designates the corona wire of the discharger, 11 an opposed electrode member, and 12 a recording medium which may be recording paper retaining the electric charge thereon. Designated by 13 and 14 are voltage source portions. The recording paper 12 is disposed near that side of the screen 1 which is adjacent to the insulating member 4, and the ion flow from the corona wire 10 disposed at the other side of the screen 1 is flowed toward the recording paper by utilization of the potential difference between the corona wire 10 and the electrode member 11. When this occurs, electric fields as indicated by solid lines $\alpha$ which block the ion flow are caused to act in the light region by the primary latent image charge on the screen 1 while electric fields as indicated by solid lines $\beta$ which pass through the ion flow are caused to act in the dark region. Thereby, a secondary latent image which is the positive of the original image is formed on the recording medium. When the screen 1 of the present invention having the above-described construction is used, the primary latent image is formed on the insulating member and thus, the electrostatic contrast resulting from the quantity of charge can be greatly enhanced. It is also possible to minimize the attenuation of the charge in the formed latent image and this enables retention copying to be achieved. However, if a semiconductor such as CdS which comprises electrons (−) as the main carrier is used as the photoconductive member 3 of the screen 1 to construct the screen such that during the formation of a primary latent image, electrons are introduced in the dark region as well, then the primary voltage applied should of course be of the opposite polarity to that mentioned in the foregoing example and during the formation of a secondary latent image, the voltage applied should all be opposite in polarity. The recording paper mentioned above comprises a conductive back-up member formed of paper treated for conductivity and an insulating layer overlaid thereon, but the recording medium which is the member for forming the secondary latent image thereon may be formed by providing on a metal substrate an insulating layer which may be film of anti-frictional insulative resin, and by repetitively using such recording medium, it will be possible to effect the image formation of the toner image transfer type.

As is apparent from the foregoing description, the ion flow passed through the screen during the secondary latent image formation or during the modulation flows along the electric line of force between the screen and the recording medium to reach the surface of the recording medium. If the screen and the recording medium are both planar at the modulating position so that the space defined therebetween is parallel to them, the electric line of force between the screen and the recording medium will be produced in the form of perpendicular lines with respect to both the screen and the medium. Thus, if the screen and the recording medium are moved at equal velocities to pass through the modulating position whereat the corona discharger is secured, the secondary latent image formed on the recording medium will be sharp and clear. In contrast, it has been found that if the screen and the recording medium are of different curvatures at the modulating position, that is, if both of them have curvatures or the screen alone has a curvature while the recording medium is planar, the secondary latent image obtained is poor in quality, particularly in resolving power, even if the two are moved at equal velocities as they pass through the modulating position. As a result of studies, this has been found to be attributable to the following reasons which will hereinafter be set forth with reference to the drawings.

Figure 6:
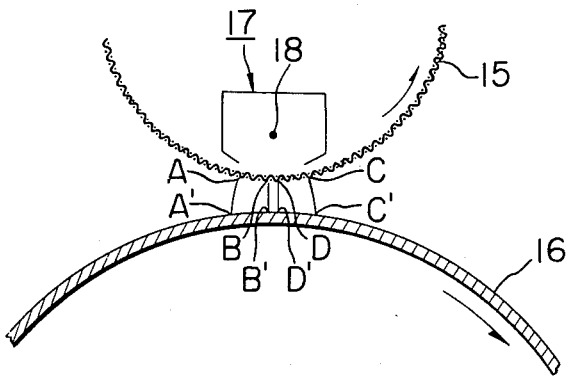
FIG. 6 is a fragmentary cross-sectional view of the screen and the recording medium at the modulating position of an image formation apparatus and illustrating the causes of the blur created during modulation.

FIG. 6 illustrates the reason why the blur is created when the ion flow or charged particles are modulated, and it particularly refers to the case where the ion flow is modulated. In FIG. 6, reference numeral 15 designates a screen which is not restricted in construction and is rotatable in the direction of the arrow. Disposed in opposed relationship with the screen is a recording medium 16 which may be an insulating drum having a different curvature from that of the screen 15 and rotatable in the direction of the arrow. Designated by 17 is a corona discharger secured at the modulating position. The corona ions produced by a discharge electrode 18 such as corona wire or the like are modulated by the primary latent image on the screen 15 and directed onto the recording medium 16 by the action of the electric field. Curves AA', BB' and CC' indicate the electric lines of force between the screen 15 and the medium 16. The screen 15 and the recording medium 16 may take a web-like form instead of the drum-like form and may be regarded as being rotated at the modulating position so as to form a cylindrical form as shown.

Figure 7:
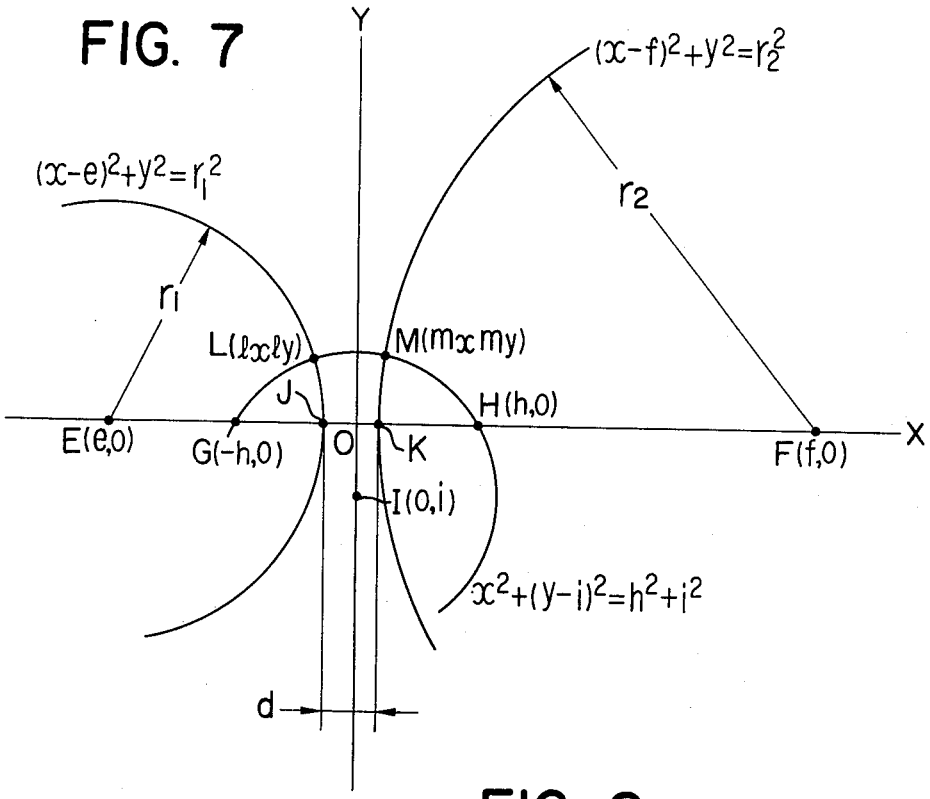
FIG. 7 illustrates the principle of the present invention.

The corona ion having passed through the point A on the screen 15 reaches the point A' and the corona ion having passed through the point B reaches the point B', but since the arcs $\widehat{AB}$ and $\widehat{A'B'}$ are not equal in length, the secondary latent image formed will be blurred if the screen 15 and the recording medium 16 are moved at the same peripheral velocity. Arc AB/arc $\widehat{A'B'}$ and nearly central, fine arc $\widehat{BD}/\widehat{B'D'}$ are slightly different, but the difference is sufficiently small if the arc AB is within not so great a range and therefore, by moving the screen 15 and the recording medium while maintaining the relation that $v_1/v_2$=arc $\widehat{BD}$/arc $\widehat{B'D'}$, where $v_1$ and $v_2$ are the peripheral velocities of the screen 15 and the recording medium 16, respectively, it is possible to eliminate the blur in the secondary latent image. FIG. 7 shows an example of the calculation of such electric field.

In FIG. 7, wherein two electrically conductive cylinders having radii $r_1$ and $r_2$, respectively are disposed with a distance d therebetween, the electric field between the two cylinders is equal to the electric field created by two imaginary conductive lines passing through points G and H and parallel to the Z-axis extending perpendicularly to the origin O shown, and this electric line of force is coincident with a cylindrical surface passing through the points G and H. Since the condition is uniform in the direction of the Z-axis, discussion will hereinafter be restricted to the XY plane. The points G and H are poles of such dipole coordinates which has coordinate plane coincident with the two cylinders.

The points G and H are determined by the following conditions:

$$\overline{EG}\cdot\overline{EH}=r_1^2 \quad (1)$$

$$\overline{FH}\cdot\overline{FG}=r_2^2 \quad (2)$$

Assume the coordinate axes with the midpoint on the line GH as the origin O, as shown, set up the centers of the circles having radii $r_1$ and $r_2$ as E and F, respectively, define their coordinates as (e,o) and (f,o), and define the coordinates of the points H and G as (h,o) and (−h,o), respectively. From equations (1) and (2) above, the following may be derived:

$$e=\frac{-r_1^2+r_2^2-(r_1+r_2+d)^2}{2(r_1+r_2+d)} \quad (3)$$

$$f=\frac{-r_1^2+r_2^2+(r_1+r_2+d)^2}{2(r_1+r_2+d)} \quad (4)$$

$$h=\sqrt{e^2-r_1^2}=\sqrt{f^2-r_2^2} \quad (5)$$

When one of the screen and the recording medium forms a plane at the modulating position, a limit may be imposed which will permit $r_1$ or $r_2$ to be infinity. Since the electric line of force between the cylinders becomes a circle passing through the points G and H, the ratio of arc $\widehat{LJ}$ to arc $\widehat{MK}$ is the value obtained above, where L and M are the intersections between the circle centered at I(O,i) and the respective cylinders and J and K are the intersections between the respective cylinders and the X-axis. Also, the y-coordinates of the intersections L and M between the circles $(x-f)^2+y^2=r_2^2$, $(x-e)^2+y^2=r_1^2$ and the circle $x^2+(y-i)^2=h^2+i^2$ are respectively represented as follows:

$$ly=\frac{1}{2(i^2+e^2)}\{i(e^2+r_1^2-h^2)\pm\sqrt{4(i^2+e^2)e^2r_1^2-e^2(e^2+r_1^2-h^2)^2}\} \quad (6)$$

$$my=\frac{1}{2(i^2+f^2)}\{i(f^2+r_2^2-h^2)\pm\sqrt{4(i^2+f^2)f^2r_2^2-f^2(f^2+r_2^2-h^2)^2}\} \quad (7)$$

Thus, the ratio of ly to my at the shortest distance between the two cylinders may be obtained:

$$\lim_{i\to\infty}\frac{my}{ly}=\frac{h^2-(|f|\pm r_2)^2}{h^2-(|e|\pm r_1)^2}$$

In this equation, $\{h^2-(|f|+r_2)^2\}/\{h^2-(|e|+r_1)^2\}$ is the value at the longest distance between the two cylinders and may be eliminated, as the result of which $\{h^2-(|f|-r_2)^2\}/\{h^2-(|e|-r_1)^2\}$ is the value sought after. However, if one of the cylinders, for example, the cylinder of radius $r_2$ is planar and $r_2$ is infinity, the above value will be $h^2/\{h^2-(|e|-r_1)^2\}$.

Actual numerical values for some specific examples will be shown below and these calculated values will further be explained in conjunction with embodiments of the present invention.

Calculation Example 1

When the radius $r_1$ of the drum-shaped screen is 55 mm and the radius $r_2$ of the insulating drum as the recording medium is 110 mm and the shortest distance d between the screen and the drum is 3 mm, then h=14.9326 mm, e=−56.9911 mm and f=111.0089 mm. For the various values of i, the values of the arcs $\widehat{MK}$ and $\widehat{LJ}$ may be obtained as shown in Table 1 below. The Table 1 shows an example of the calculation of the corresponding arc lengths $\widehat{LJ}$ and $\widehat{MK}$ of the screen drum having a screen extended over the surface thereof and the insulating drum for forming a secondary image thereon. This table refers to the case where the radii of the screen drum and the insulating drum are 55 mm and 110 mm, respectively, and the distance therebetween is 3 mm.

TABLE 1

Calculation of the corresponding arc lengths $\widehat{LJ}$ and $\widehat{MK}$ of the screen drum and the insulating drum

| | | | | | |
|---|---|---|---|---|---|
| $-i_\infty$ (mm) | | 43.3464 | 19.7982 | 11.1155 | 6.14910 |
| $\widehat{MK}$ (mm) | 0 | 2.48846 | 4.97629 | 7.45283 | 9.94752 |
| $\widehat{LJ}$ (mm) | 0 | 2.45515 | 4.90785 | 7.35566 | 9.79623 |
| MK / $\widehat{LJ}$ | 1.0134 | 1.0136 | 1.0140 | 1.0146 | 1.0154 |

As is apparent from Table 1 above, when the radius of the screen, the radius of the insulating drum and the distance therebetween are 55 mm, 110 mm and 3 mm, respectively, the points on the screen can always correspond to the points on the insulating drum if the peripheral velocity of the insulating drum is 1.013 to 1.015 times the peripheral velocity of the screen drum, whereby blur can be prevented. It is also seen from Table 1 that when the peripheral velocities of the screen and the insulating drum are equal, if the slit width over which the ions for the secondary latent image formation are imparted is set to 10 mm, a corresponding point on the insulating drum moves over 10.14 mm while the screen drum moves over 10 mm. From this, it will be appreciated that a maximum blur of about 0.14 mm is created in the secondary latent image on the insulating drum.

Calculation Example 2

When $r_1=55$ mm, $r_2=11$ mm and $d=2$ mm, then $h=12.1838$ mm, $e=-56.3333$ mm and $f=111.6667$ mm and MK/LJ for the maximum of i is 1.00909.

Calculation Example 3

When $r_1=55$ mm, $r_2=\infty$ (the insulating drum forms a plane at the modulating position) and $d=3$ mm, then $h=18.4119$ mm, $e=-58$ mm and $f=\infty$ and MK/LJ for the maximum of i is 1.0273. When $-i$ is 11.9500 mm, then MK=10 mm, LJ=9.70922 mm and MK/LJ=1.0300.

Calculation Example 4

When $r_1=55$ mm, $r_2=80.4$ mm and $d=2.6$ mm, then $h=13.1030$ mm, $e=-56.5393$ mm and $f=-81.4607$ mm and MK/LJ for $i=\infty$ is 1.00734.

In the foregoing Calculation Examples 2 to 4, symbols similar to those in Calculation Example 1 are used. In Calculation Example 1, the radii $r_1$ and $r_2$ are assumed for the screen and the insulating drum, respectively, but there may of course be a case where $r_1$ is available for the insulating drum and $r_2$ for the screen.

It will thus be seen that the above-described method can prevent any blur from being created in the image on the recording medium during modulation of the ion flow. Where the radius of the screen is smaller than that of the recording medium, the secondary latent image formed on the recording medium is equal in axial dimension but somewhat enlarged in circumferential direction, with respect to the primary latent image on the screen 1. When the enlargement of the image on the recording medium is within an allowable range, no special means need not be provided for, but when the enlargement of said image is within a practically questionable range, the primary latent image may generally be reduced moderately with respect to the original image. By this, the modulated image on the recording medium will be slightly reduced in axial direction and slightly enlarged in circumferential direction, thus becoming approximate to the original image. Also, where an insulating drum is used as the recording medium, the "elongation" of the aforementioned image may be corrected also by utilization of the difference in shrinkage rate between the longitudinal and the lateral direction during humidification or dehumidification of the image transfer medium such as plain paper or the like. Further, where the rate of enlargement is within an unallowable range exceeding several percent, the above described correction may be effected with the primary latent image being reduced only in the circumferential direction by optical means for image projection which will later be described, thus preventing unnatural "elongation" of the image.

By controlling the velocities of the screen and the recording medium in the manner described, the on the recording medium may be eliminated and if required, the elongation of the image on the recording medium in the circumferential direction thereof may be prevented, so that there may be provided a good image faithful to the original image.

Figure 8:
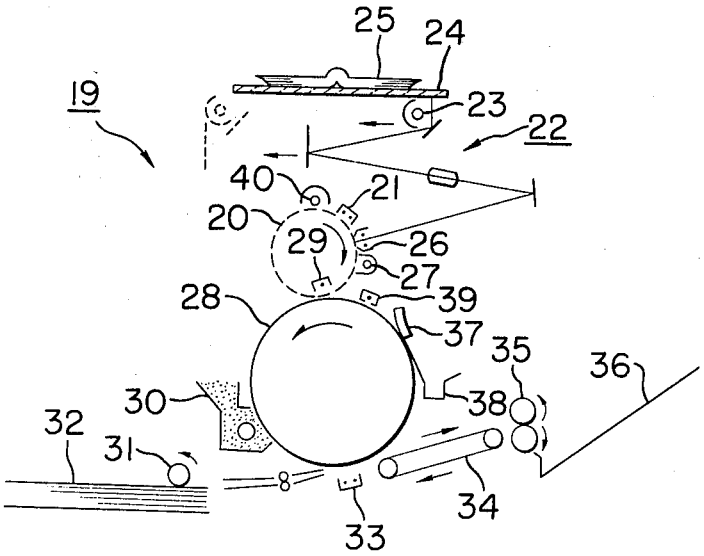
FIGS. 8 and 9 are schematic cross-sectional views of electrophotographic copying apparatus to which the present invention is applied.

Applications of the present invention to a copying apparatus as the image forming apparatus will now be described with respect to the embodiments shown in FIGS. 8 and 9.

Embodiment 1

An electrophotographic copying apparatus 19 has a screen drum which is provided by forming the screen described in connection with FIG. 1 into a drum shape so that the insulating member thereof occupies the outer peripheral surface of the drum. The formation of a latent image on the drum 20 is accomplished by the process described in connection with FIGS. 2 to 5. The conductive member of the screen is prepared by etching a stainless metal plate of 30μ thickness to form therein fine openings of 70μ diameter at a rate of 10 openings per millimeter (100 openings per square millimeter). Subsequently, a layer of CdS particles bound together by resin is formed on the conductive member by the spray method so that the conductive member is exposed only at one side thereof, and an insulating layer is further formed on that layer, thus providing the screen. Such screen is then adhered to a support member comprising a connector band 20*a* and annular members 20*b* secured to the opposite ends of the connector band, whereby there is provided screen drum 20.

The screen drum 20 is rotated in the direction of the arrow by drive means (not shown) and uniformly charged at a primary voltage of +7 KV by a corona discharger 21, whereafter the image of an original 25 on an original carriage illuminated by a lamp 23 is split-projected through optical means 22 including mirrors and lens system. Simultaneously with the projection of the image, the screen drum 20 is subjected to a secondary voltage which is −200 V superposed on AC corona discharge of 7 KV, and then subjected to allover exposure by a lamp 27 to form a primary latent image. At this point, a grounded insulating drum 28 starts to be rotated in the direction of arrow at a higher peripheral velocity than that during the primary image formation, with the screen drum connected to the drum 28 by gearing. The insulating drum 28 comprises a drum substrate of aluminum covered with a 15μ thick layer of insulative material such as resin or the like provided by coating or adhesion. By the above-described mechanism, corona ions of −11 KV are imparted to the insulating drum 28 form an ion modulating corona discharger 29 disposed within the screen drum 20, through the primary latent image on the screen drum 20 to which −5 KV is being applied, whereby a secondary image at about −300 V is formed on the insulating drum 28. Thereafter, the secondary latent image on the insulating drum 28 is toner-developed by a developing device 30, and then the toner image is transferred to transfer paper 32 such as plain paper by the action of an image transfer corona discharger at −6 KV, the transfer paper being supplied by a supply roller 31. The transfer paper 32 now bearing the toner image thereon is conveyed on a conveyor belt 34 into a heat roller fixing device 35 for heat fixation, from which the paper is discharged onto a discharge tray 36. A cleaning blade 37 for removing any excess toner is disposed at a circumferential portion of the insulating drum 28, and a toner collector 38 is provided for collecting the toner removed by the blade 37. The toner collector 38 is connected to the developing device 30 by transport means such as screw (not shown) so that the toner in the collector 38 is reusable. A corona discharger 39 of the positive polarity (+) is provided for deelectrifying the insulating drum 28 when it has been cleaned up. By the discharger 39, the secondary electrostatic latent image is all removed from the insulating drum, which is thus ready for another cycle of electrostatic latent image formation. A lamp 40 disposed at a circumferential portion of the screen drum 20 serves to impart a uniform light history to the screen drum 20.

In the above-described apparatus, if the diameter of the screen drum is 110 mm and the diameter of the insulating drum is 220 mm and the distance therebetween is 3 mm and if the number of teeth of the screen drum gear is 111 and the number of teeth of the insulating drum gear is 222 and the two drums are rotated at equal peripheral velocities, then it has been found that the resolution of the image on the insulating drum in the circumferential direction thereof is as bad as to provide a blur of 0.1 mm or more. (See Calculation Example 1). If the number of teeth of the screen drum gear and the number of teeth of the insulating drum gear are 112 and 221 (the peripheral velocity of the latter drum is 1.0136 times that of the former drum), the resolution of the image on the insulating drum is so much improved that 6.3 lines per millimeter are resolved, thus eliminating any blur which will offer inconvenience in practice. If the number of teeth of the screen drum gear and of the insulating drum gear are 112 and 222, the ratio of peripheral velocity between the two drums is 1.009 which means an insufficient correction, but resolution of 5 lines per millimeter has been obtained to provide a practicable image. If the numbers of teeth of the two drum gears are 111 and 221, the ratio of peripheral velocity is 1.0045 and in such case, resolution of 5 lines per millimeter is difficult to obtain.

When a drum-shaped screen and recording medium having different radii are employed, it is possible to prevent blur of the image by rotation the member with the larger radius at a higher peripheral velocity than the member with the smaller radius in accordance with these radii and with the above-described principle.

Embodiment 2

In an apparatus similar to that of Embodiment 1, the diameter of the screen drum is 110 mm, the diameter of the insulating drum is 222 mm and the distance therebetween is 2 mm. (See Calculation Example 2.) When the number of teeth of the screen drum gear and of the insulating drum gear are 110 and 220 respectively (the peripheral velocity of the latter drum is 1.0091 times that of the former drum), the formed image is good in resolution. In this embodiment, the number of teeth of the insulating drum gear is a multiple of the screen drum gear so that during retention copying, the secondary electrostatic latent image is ensured to be formed always at the same position on the insulating drum.

Embodiment 3

Figure 9:
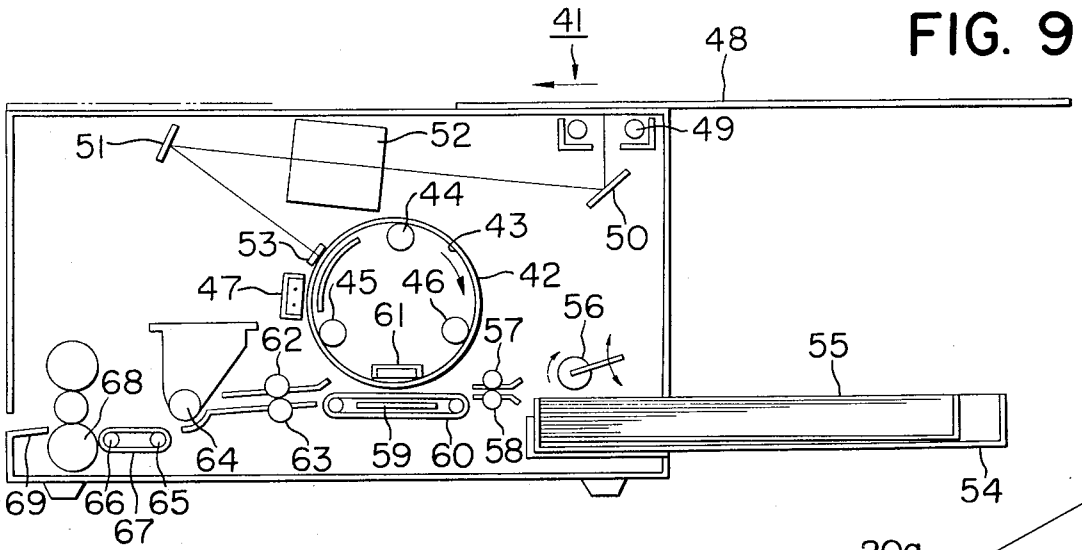
Figure 10:
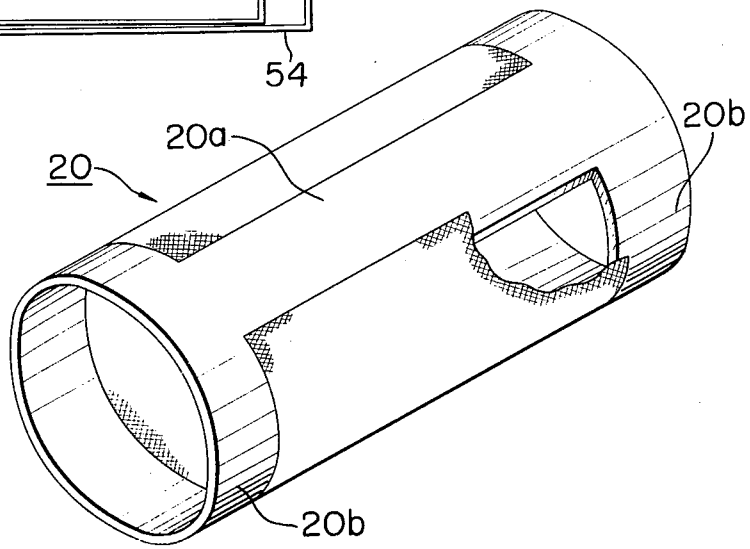
FIG. 10 is a perspective view of a screen drum supporting thereon the screen used in the apparatus of FIG. 9.

The screen of the screen drum 42 used in the electrophotographic copying apparatus of FIG. 9 differs from the embodiments described above and comprises an electrically conductive member and a photoconductive member. This screen is made by knitting a stainless wire of 40μ diameter into a conductive member of 200 meshes and vacuum-evaporating Se on such conductive member so as not to clog the openings thereof. The evaporation of the photoconductive member is effected so as to provide a maximum thickness of about 50μ and particularly effected only on one side of the screen so that the electrically conductive member is exposed on one side of the screen. The evaporation of the photoconductive member could be effected after the electrically conductive member was extended over a screen support member 43. The screen so prepared is disposed with the evaporated photoconductive member exposed in the outer peripheral surface, thus providing a screen drum 42 identical in construction with the screen drum 20 already described in Embodiment 1. The support member 43 is rotatably supported by rollers 44, 45 and 46. The screen used in the present embodiment serves to form thereon a primary latent image with the aid of charging and exposure and control the passage of the ion flow with the aid of the charge in the openings thereof. This screen is fully described in our U.S. Application Ser. No. 469,892.

In order that a primary latent image corresponding to an original image may be formed on the screen drum 42, the screen drum is first charged to +500 V by a corona discharger 47. Thereafter, the image of the original (not shown) placed on the glass plate of a movable original carriage 48 moved at a velocity somewhat higher than the peripheral velocity of the screen drum 42 is illuminated by a lamp 49 and projected onto the screen drum 42 rotating in the direction of the arrow, via mirrors 50, 51, a lens system 52 and a cylindrical lens 53 which magnifies the optical image 0.973 times only in the circumferential direction of the screen drum, whereby a primary latent image is formed on the screen drum. As the screen drum 42 with the primary latent image formed thereon is rotated to a position in which a secondary latent image is formed, a sheet of transfer paper 55 similar to that used in the FIG. 8 embodiment is fed from a paper supply cassette 54 by a supply roller 56 and through register rollers 57, 58 and conveyed on a conveyor belt 60 containing suction means 59 therewithin. The register rollers 57, 58 are operated by conventional control means so that the portion of the screen drum 42 which bears the primary latent image and the transfer paper 55 are timed with each other at the modulating position, and the conveyor belt 60 conveys the transfer paper at a velocity 1.028 times the peripheral velocity of the screen drum 42.

When the screen drum 42 has reached the modulating position, a corona ion flow is imparted from a corona discharger 61 securely mounted within the screen drum 42, so that a secondary latent image is formed on the transfer paper on the conveyor belt 60 which is spaced apart by 3 mm from the primary latent image. The corona discharge from the corona discharger 61 is of the negative polarity. On the other hand, a voltage of +3 KV is being applied to the conveyor belt 60 which is formed of electrically conductive rubber to provide an opposed electrode. The transfer paper with a secondary latent image so formed thereon is transported by transport rollers 62, 63 to a developing device 64, by which the secondary latent image is developed, whereafter the transfer paper is conveyed by a belt 67 extended between and over rollers 65 and 66 to reach a heat roller fixing device 68 which accommodates a heat source therein. The transfer paper has the toner image thereon fixed by the heat roller fixing device 68, whereafter the paper is discharged out of the apparatus by a guide plate 69, thus completing a copy image. The completed copy image is equal in size to the image original and moreover, sharp and clear.

Any of the above-described embodiments of the present invention has been shown as being of the type in which the secondary latent image is formed on the recording medium in accordance with the primary latent image formed on the screen. However, the present invention is applicable not only to the ion modulation but also to the modulation of charged particles such as toner particles having charges. Further, the screen is not restricted in shape and construction as long as it is directed to the formation of an image without making contact with the recording medium. Furthermore, the screen usable with the present invention is not restricted to the screen having a photoconductive member but screens having openings shaped like character or other images may also be used. Also, the visualization of the latent image on the recording medium is not restricted to the shown method but may be accomplished by a method whereby a visible image may be obtained directly on the recording medium by electrostatically capturing the developer mist during ion modulation. A further alternative method of the image visualization is to impart an ion flow to a recording medium having no conductive layer through a primary latent image while, at the same time, imparting electrically conductive developer to the other surface of the recording medium than that which bears a secondary latent image.

According to the present invention, as will be appreciated, a screen and a recording medium are formed into cylinders of different radii and the one with the larger radius is rotated at a higher velocity than the smaller-radiused one with the smaller radius, or one of a screen and a recording medium is formed into a cylinder while the other is constructed into a planar form and the planar member is moved at a higher velocity than the other member. The velocities of movement may be determined in the following manner, for example. As viewed in the Descartes coordinates, let the polar positions in dipole coordinates having coordinate planes coincident with the screen at the ion or charged particle modulating position and the recording medium formed of an electrically chargeable member such as electrostatic recording paper or insulating drum be (h,o) and (−h,o) respectively, and let the coordinates of the centers and the radii of the screen and the recording medium be (e,o), (f,o), $r_1$ and $r_2$, respectively. Then determine the velocities $v_1$ and $v_2$ of the screen and the recording medium in accordance with:

$$\frac{v_2}{v_1} = \frac{h^2 - (|f| - r_2)^2}{h^2 - (|e| - r_1)^2}$$

If one of the screen and the recording medium is planar, the value of either $r_1$ or $r_2$ is infinity and thus, $$v_2/v_1 = \{h^2 - (|f| - r_2)^2\}/h^2 \text{ or}$$
$$v_2/v_1 = h^2/\{h^2 - (|e| - r_1)^2\}.$$

By controlling the velocities of rotation or movement of the screen or the recording medium to a value equal to the value so obtained, it is possible to form a copy image faithfully corresponding to an original image. Further, when use is made of a screen which has an insulative layer or the like on the surface as shown in FIG. 1 to thereby permit retention copying, it will be possible to obtain accurate copy images at a higher speed and by a more compact construction.

As noted above, rotation or movement of the screen and the recording medium at different velocities may result in formation of a copy image enlarged or reduced in the direction of rotation or movement, but such enlargement or reduction need not be corrected if it offers virtually no inconvenience. If correction is required, the image information on the screen may in advance be enlarged or reduced in the direction of rotation or movement as by optically correcting the image during image projection. For example, where the screen and the recording medium are both drum-shaped and the screen is smaller in radius than the recording medium and if the screen is a photosensitive one, a primary latent image reduced in the direction of rotation of the screen is formed by operation of the cylindrical lens and the original carriage or the mirrors during image projection. Conversely, where the screen is greater in radius than the recording medium, the primary latent image formed on the screen will of course be one which is enlarged in the direction of rotation of the screen. Also, where the exposure slit width is small, the means for enlarging or reducing the image only in one direction will not be such special optical means as the cylindrical lens but may be provided simply by varying the scanning velocities for the image original and the screen as required.

What is claimed is:

1. An image formation method for forming an image on an image reception member by modulating an ion flow or charge particles at a modulating position with the aid of a screen member having a number of fine passage openings, wherein said screen member and said reception member each have an arcuate cross-section at the modulating position and a different radius of curvature, said method comprising:

forming a primary image on said screen member;

forming a secondary image on said image reception member with ion flow or charged particles modulated by the primary image; and rotating or moving, during modulation, said screen member and said image reception member at different peripheral speeds at the modulating position, the peripheral speed of the member having the larger radius of curvature being greater than the peripheral speed of the other member, whereby a sharp secondary image corresponding to the primary image is formed on said image reception member.

2. A image formation method according to claim 1, wherein said screen member and said image reception member are drums having different radii.

3. An image formation method according to claim 13, wherein said one member is drum-shaped.

4. An image formation method for forming an image on an image reception member by modulating an ion flow or charged particles at a modulating position with the aid of a screen member having a number of fine passage openings, wherein at least one of said members has an arcuate cross-section at the modulating position, said method comprising:

forming a primary image on said screen;

forming a secondary image on said image reception member with an ion flow or charged particles modulated by said primary image; and setting the velocities of rotation or movement ($v_1$,$v_2$) of said screen and said image reception member, during modulation, at the modulating position substantially to $V_2/V_1=\{h^2-(|f|-r_2)^2\}/\{h^2-(|e|-r_1)^2\}$, where (h,o) and (−h,o) are the polar positions, as viewed in the Descartes coordinates, of dipole coordinates having coordinate planes coincident with said screen and said image reception member at the modulating position, and (e,o), (f,o) $r_1$ and $r_2$ are the coordinates of the centers and curvature radii of said screen and said image reception member, wherein $O<r_1\leqq\infty$, $O<r_2\leqq\infty$ and $r_1\neq r_2$.

5. An image formation method according to claim 4, wherein said screen is smaller in radius than said image reception member and the image formed on said screen is reduced in the direction of rotation or movement.

6. An image formation method according to claim 4, wherein if said screen is larger in radius than said image reception member, the image formed on said screen is enlarged in the direction of rotation or movement.

7. An image formation method according to claim 5, wherein said screen is drum-shaped and said image reception member is planar and $v_2/v_1$ equals $h^2/\{h^2-(|e|-r_1)^2\}$.

8. An image formation method according to claim 6, wherein said screen is planar and said image reception member is drum-shaped and $v_2/v_1$ equals $\{h^2-(|f|-r_2)^2\}/h^2$.

9. An image formation method for forming an image on an image reception member by modulating an ion flow or charged particles at a modulating position with the aid of a screen member having a number of fine passage openings, wherein both members are drum shaped, said method comprising:

forming a primary latent image on said screen member;

then forming a secondary latent image on said reception member with an ion flow or charged particle modulated by said primary latent image; and rotating, during modulation, said screen member and said image reception member at different peripheral speeds at the modulation position, the peripheral speed of the member having the larger radius of curvature being greater than the speed of the other member, whereby a sharp secondary latent image corresponding to the primary latent image is formed on said image reception member.

10. An image formation method according to claim 9, wherein the velocities of rotation or movement ($v_1$,$v_2$) of said screen member and said image reception member at the modulating position are substantially set to $v_2/v_1=\{h^2-(|f|-r_2)^2\}/\{h^2-(|e|-r_1)^2\}$, where (h,o) and (−h,o) are the polar positions, as viewed in the Descartes coordinates, of dipole coordinates having coordinate planes coincident with said screen member and said image reception member at the modulating position, and (e,o), (f,o), $r_1$ and $r_2$ are the coordinates of the centers and curvature radii of said screen member and said image reception member.

11. An image formation method according to claim 10, wherein the primary latent image on said screen member is changed in its magnification in the direction of movement of said screen member and the ion flow is modulated by the so changed primary latent image to thereby prevent the secondary latent image from being changed in the direction of rotation.

12. An image formation method according to claim 11, wherein image exposure means for said screen member is provided to change the magnification of said primary latent image.

13. An image formation method for forming an image on an image reception member by modulating an ion flow or charged particles at a modulation position with the aid of a screen member having a number of fine passage openings, wherein one of said members has an arcuate cross-section at the modulation position while the other member has a linear cross-section, said method comprising:

forming a primary image on said screen member;

forming a secondary image on said image reception member with ion flow or charged particles modulated by said primary image; and rotating or moving, during modulation, said screen member and said image reception member at different relative speeds at the modulating position, the peripheral speed of said one member being less than that of said other member, whereby a sharp secondary image corresponding to the primary image is formed on said image reception member.

14. An image formation method for forming an image of an original on an image reception member by modulating an ion flow or charged particles at a modulating position with the aid of a screen-shaped photosensitive member, wherein said screen member and said image reception member form, at said modulating station, have arcuate cross-sections having radii $r_1$ and $r_2$, respectively, where $r_1\neq r_2$, $O<r_1\leqq\infty$, $O<r_2\leqq\infty$, said method comprising:

forming a primary image on said screen member;

forming a secondary image on said image reception member with an ion flow or charged particles modulated by the primary image; and rotating or moving, during modulation, said screen member and said image reception member at different peripheral speeds at the modulating position, the peripheral speed of the member having the larger radius of curvature being greater than the peripheral speed of the other member, whereby a sharp secondary image corresponding to the primary image is formed on said image reception member.

15. An image formation method according to claim 14, wherein the primary latent image on said screen member is changed in its magnification in the direction of rotation or movement of said screen member and the ion flow or the charged particles are modulated by the so changed primary latent image to thereby prevent the secondary latent image from being changed in its magnification with respect to the image of the original in the direction of rotation or movement.

16. An image formation method according to claim 15, wherein said screen member is smaller in radius than said image reception member, and the primary image formed on said screen member is reduced in the direction of rotation or movement.

17. An image formation method according to claim 15, wherein image exposure means for said screen member is provided to change the magnification of said primary latent image.

18. An image formation method according to claim 14, wherein said image reception member is a sheet member, and the secondary image formed on the sheet member is developed by developing means, and then fixed by fixing means.

19. An image formation method according to claim 14, wherein said image reception member is a drum member, and said secondary image formed on the drum member is developed by developing means, and then transferred onto a transfer material, whereafter said drum member is cleaned by cleaning means to be used repeatedly.

20. An image formation method according to claim 14, wherein the peripheral speed of said screen member is different from the scanning speed of the original, when the primary image is formed.

21. An image formation method according to claim 20, wherein the scanning of the original is effected by moving an original carriage for carrying the original.

22. An image formation method according to claim 21, wherein the speed of movement of said original carriage is higher than the peripheral speed of said screen member, when the radius $r_1 <$ the radius $r_2$.

23. An image formation method according to claim 14, wherein said screen member comprises at least a conductive member with a number of fine passage openings and a photoconductive layer, and wherein said primary image is formed at least by the steps of electrically charging said screen member and applying a light image of the original to said screen member.

24. An image formation method according to claim 14, wherein said screen member comprises a conductive member with a number of fine passage openings, a photoconductive layer, and an insulating surface layer, and wherein said primary image is formed by the steps of applying a first corona to said screen member, applying a second corona and a light image of the original to said screen member either simultaneous or in succession and then uniformly exposing said screen member to light.

25. An image formation method according to claim 1 or 14, wherein said screen member and said reception member are each movable about a separate central axis.

26. An image formation method according to claim 15, wherein said screen member is larger in radius than said image reception member, and the image formed on said screen member is enlarged in the direction of rotation or movement.

27. An electrographic process comprising using a screen-shaped photosensitive body composed of at least one electric conductive layer and photoconductive layer, uniformly charging said photoconductive layer, illuminating said screen-shaped photosensitive body with a light image corresponding to a picture image of a manuscript to be recorded so as to form an electrostatic latent image on said photoconductive layer, directing a flow of corona ions through said screen-shaped photosensitive body toward a dielectric coated image receiving body and controlling said flow of corona ions by said electrostatic latent image to form, on said dielectric coated image receiving body, an electrostatic charge image corresponding to an image to be recorded, said process comprising a further step of making a radius of curvature of said screen-shaped photosensitive body different from that of said dielectric coated image receiving body, arranging these two bodies in opposed and spaced apart relation and driving said two bodies at surface speeds which are different from each other.

28. An electrophotographic process as claimed in claim 27, wherein a manuscript scanning speed is made different from a moving speed of said screen-shaped photosensitive body and a cylindrical convex lens for changing a projection magnification in the manuscript scanning direction only is arranged in an optical system for projecting a manuscript picture image on said screen-shaped photosensitive body.

29. An electrographic process as claimed in claim 27, wherein a manuscript scanning speed is made different from a surface speed of said screen-shaped photosensitive body and a cylindrical lens for changing a projection magnification in the manuscript scanning direction only is arranged in an optical system for projecting a manuscript picture image on said screen-shaped photosensitive body.

30. An electrographic process according to claim 27, wherein said photosensitive body and said image receiving body are each movable about a separate central axis.

* * * * *

UNITED STATES PATENT OFFICE

CERTIFICATE OF CORRECTION

Patent No. 4,284,697 Dated August 18, 1981

Inventor(s) YUJIRO ANDO, ET AL.

It is certified that error appears in the above-identified patent and that said Letters Patent are hereby corrected as shown below:

Column 3, line 34, "illustrate" should read --illustrates--;

Column 8, line 14, after "on" insert --blur--;
line 67, "form" should read --from--;

Column 9, line 18, after "as" insert --a--;
line 56, after "rotation" insert --of--;

Column 13, line 35, Claim 6, delete "if" after "wherein";
line 36, delete the comma after "member";
insert --and-- before "the".

Signed and Sealed this

Ninth Day of February 1982

[SEAL]

Attest:

GERALD J. MOSSINGHOFF

Attesting Officer

Commissioner of Patents and Trademarks